US006892907B2

(12) United States Patent
Varney

(10) Patent No.: US 6,892,907 B2
(45) Date of Patent: May 17, 2005

(54) CONDENSATE DRIP PAN DECONTAMINANT DEVICE

(76) Inventor: Theodore Sherwood Varney, 636 Carter Rd., Ridgeville, SC (US) 29472

( * ) Notice: Subject to any disclaimer, the term of this patent is extended or adjusted under 35 U.S.C. 154(b) by 56 days.

(21) Appl. No.: 10/340,698

(22) Filed: Jan. 10, 2003

(65) Prior Publication Data

US 2003/0132251 A1 Jul. 17, 2003

Related U.S. Application Data

(60) Provisional application No. 60/346,869, filed on Jan. 10, 2002.

(51) Int. Cl.[7] ..... B67D 3/00

(52) U.S. Cl. ..... 222/527; 222/108; 222/181.2; 222/185.1; 222/529

(58) Field of Search ..... 222/527, 529, 222/185.1, 181.1, 181.2, 180, 108, 174

(56) References Cited

U.S. PATENT DOCUMENTS 2,954,028 A * 9/1960 Smith ..... 604/80
3,165,241 A * 1/1965 Curry ..... 222/490
3,227,173 A * 1/1966 Bernstein ..... 137/192
4,312,493 A * 1/1982 Stauffer ..... 251/8
4,744,536 A * 5/1988 Bancalari ..... 248/125.8
4,908,018 A * 3/1990 Thomsen ..... 604/83
5,139,172 A * 8/1992 Brown ..... 222/181.2
5,379,813 A * 1/1995 Ing ..... 141/351
5,697,904 A 12/1997 Raines et al.
5,725,156 A * 3/1998 Park ..... 239/379
5,921,443 A * 7/1999 McMillan ..... 222/174

* cited by examiner

*Primary Examiner*—Frederick Nicolas
(74) *Attorney, Agent, or Firm*—Harleston Law Firm, LLC; Kathleen M. Harleston

(57) ABSTRACT

A device for holding and dispensing a fluid for decontaminating a condensate drip pan of an air conditioner includes:

(a) a vessel at one end of the device for holding the fluid; and (b) at least one fluid line having a first end inserted in a lower end of the vessel, and an opposite, lower, second end inserted in the drip or drain pan;

(c) a flow control device on the fluid line for controlling a rate of fluid drip from the fluid line into the drip or drain pan; and (d) a drip chamber in the fluid line.

9 Claims, 8 Drawing Sheets

CONDENSATE DRIP PAN DECONTAMINANT DEVICE

CROSS REFERENCE TO RELATED DOCUMENT

This invention was described in Provisional U.S. patent application Ser. No. 60/346,869, which was filed on Jan. 10, 2002. Provisional U.S. Patent Application No. 60/346,869 was described in Disclosure Document Number 483308, which was received by the U.S. Patent & Trademark Office on Nov. 30, 2000.

BACKGROUND OF THE INVENTION

1. Technical Field

The present invention relates to a device for holding and dispensing a fluid for decontaminating the condensate drip pan of an air conditioner unit or the like over time.

2. Background Information

Consumers, particularly parents, have of late become more concerned about sources of mold and bacteria in the home and workplace. Purchases of antibacterial liquid soaps, bathroom sprays, and kitchen cleansers have increased in the last decade. Newspapers bear stories about harmful molds growing in school buildings and related allergies among schoolchildren and teachers. One hidden medium that fosters the growth of bacteria and mold in many homes is the air conditioner drip pan, in which condensate from the HVAC (heating/ventilation/air conditioning) unit is collected. Homeowners often forget about periodically emptying and cleaning their air conditioning unit condensate drip pan, which is often hidden up in the attic or behind a closet door. If the air conditioner drip pan is not cleaned, it can be a nutritious environment for mold and other deleterious microorganisms.

Some homeowners have other sources in their home that slowly drip water, such as a drip from a leaky pipe under a kitchen sink or under the house, or from a leaky roof. Although pans placed under the drips do prevent the pipe or rain water from damaging the floor of the cabinet or home, the drips collect and can likewise foster the growth of undesirable microorganisms in the drip collection pan.

The present invention is a device for holding and dispensing an antimicrobial fluid for decontaminating the drip pan of an air conditioner unit, or other water source. Use of the present device over time effectively kills the molds and bacteria that grow in the drip pan of an air conditioner system or the like and effectively inhibits microbial regrowth. The device can also or alternatively be used to drip a viscous fragrant fluid over the condensation coils of the air conditioner unit, emitting a pleasant odor through the house or other building.

BRIEF SUMMARY OF THE INVENTION

The present invention is a device for holding and dispensing a fluid for decontaminating the condensate drip pan of an air conditioner or the like over time, which includes:

(a) a vessel at one end of the device for holding the fluid; and (b) at least one fluid line having a first end inserted in a lower end of the vessel, and an opposite, lower, second end inserted in the drip or drain pan;

(c) a flow control device on the fluid line for controlling a rate of fluid drip from the fluid line into the drip or drain pan; and (d) a drip chamber in the fluid line.

The device can also or alternatively be used to drip a viscous fragrant fluid over the condensation coils of the air conditioner unit, emitting a pleasant odor through the house or other building.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
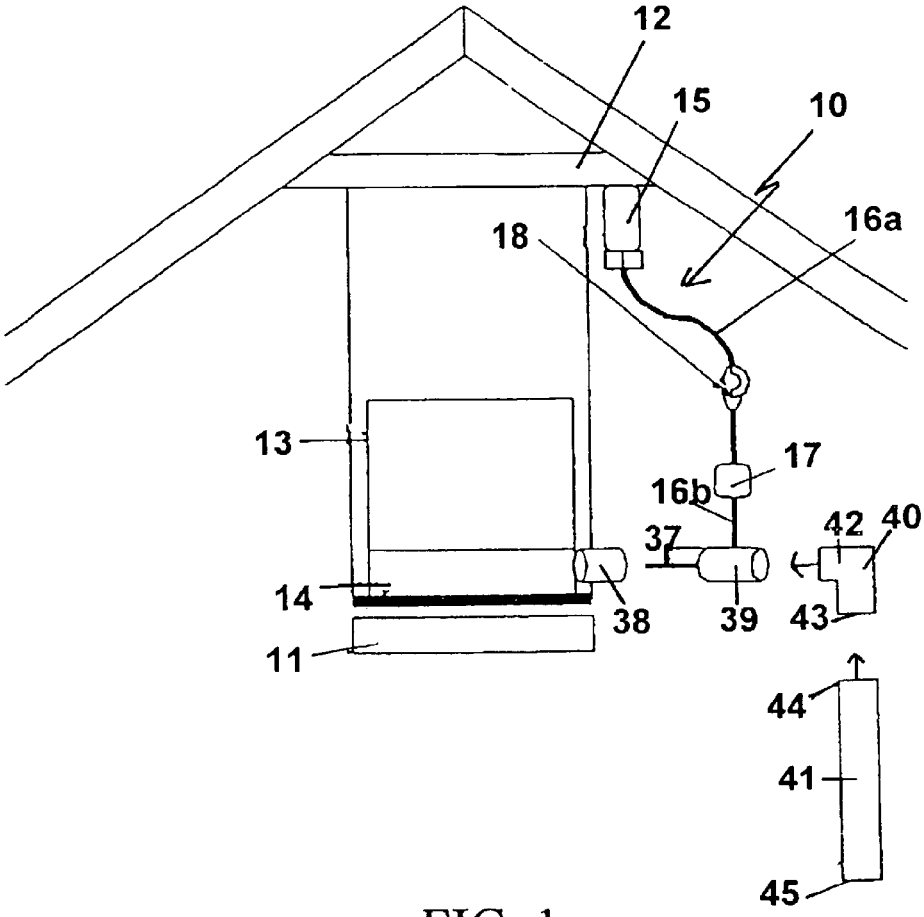
FIG. 1 shows a schematic view of a decontaminant device according to the present invention, shown installed in an attic.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a device, generally referred to as 10, for holding and dispensing a fluid for decontaminating a condensate drip pan 11 over time is ordinarily installed under the eaves 12 of a home adjacent to an air conditioner unit (HVAC) 13, so that fluid drips from the decontaminating device 10 into a condensate drain pan 14, which is part of the air conditioner unit 13 and above the condensate drip pan 11. Overflow from the (internal) drain pan 14 drips into the external, larger size (secondary) drip pan 11 beneath the drain pan. The device 10 is comprised of three basic portions: a vessel 15 for holding the fluid, a fluid line 16 connected to a lower end of the vessel 15, an in-line drip chamber 17, and a flow control device 18 for regulating the flow of fluid through the line into the condensate drain pan 14.

Advantages of the device of the present invention include the following:

1) The present device is inexpensive, reliable, and easy to install and refill.
2) The device is universal in that it can be used for many different types of condensate drip pans.
3) The vessel of the device holds a variety of different types of decontaminant fluid, preferably a bleach solution.
4) Use of the device over time effectively kills the molds and bacteria that grow in the drip pan of an air conditioner (HVAC) system and inhibits regrowth.
5) Inhibiting microbial growth results in better health for occupants of the home, hospital, clinic, etc., and the lack of odors associated with bacterial growth in the drip pan translates to better air quality in the home.

Figure 2:
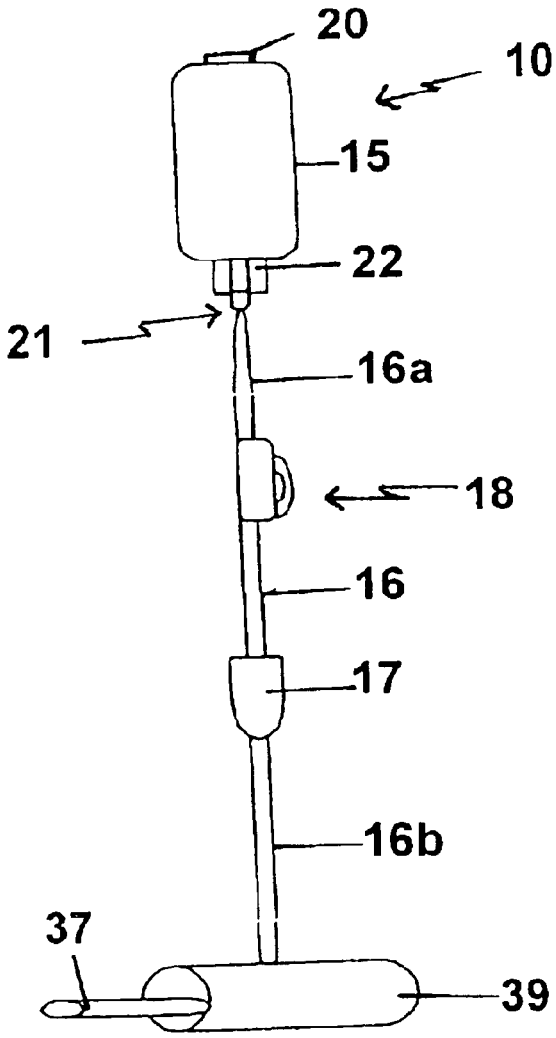
FIG. 2 is an perspective view of an alternate embodiment of a decontaminant device according to the present invention.

Referring to FIGS. 1 and 2, the vessel 15 is preferably a bag or bottle, most preferably a 32 ounce plastic-type sample bottle with a screw-off plastic cap 20 at its correspondingly threaded upper end opening. The screw-off cap can be removed for refilling the bottle. The vessel 15 is shown removably suspended from an eave 12 in the attic of the house, as by a hook attached to the eave inserted through a corresponding eye affixed to the outside of the upper portion of the bottle. Where the vessel is a flexible bag, it may be supported by means of a stand.

Figure 3:
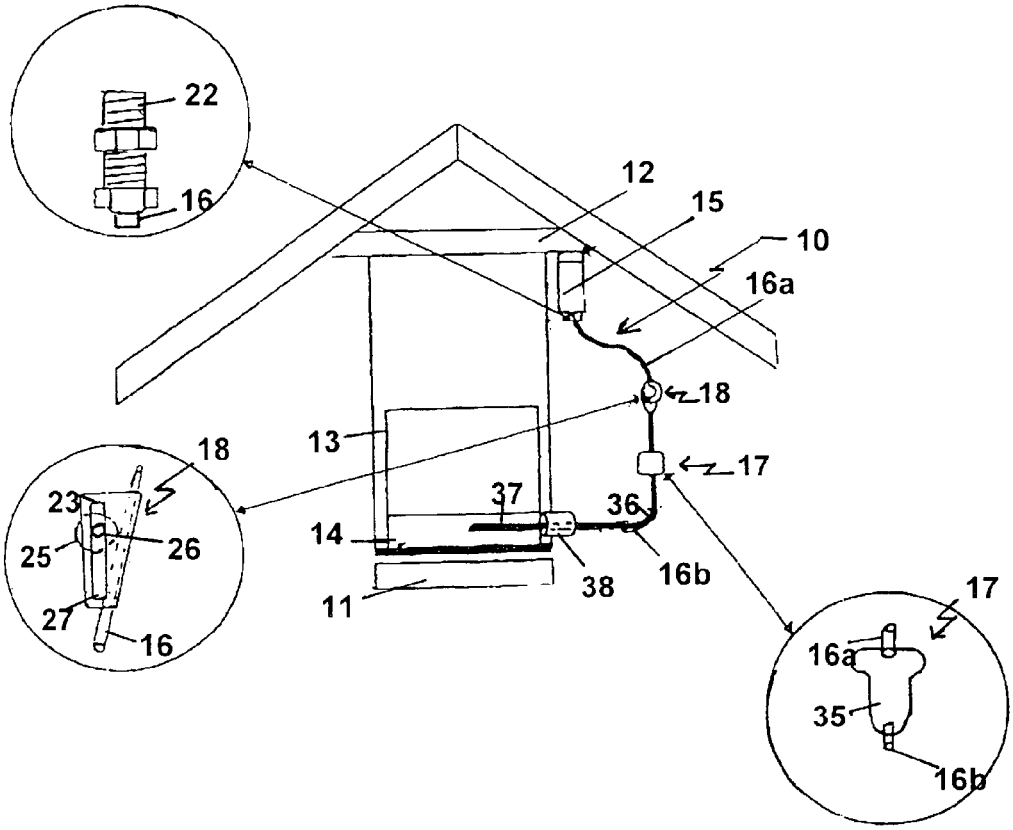
FIG. 3 is a perspective view of an alternate embodiment of a decontaminant device according to the present invention, showing expanded views of several of the parts.

Referring to FIGS. 1, 2, and 3, the fluid line 16 is preferably a section of medical tubing, which is flexible and durable over time despite the often caustic fluid passing through it. The fluid line 16 most preferably has an inside diameter of ⅛ inch, an outside diameter of ¼ inch, and a 1/16 inch wall. An upper end 21 of the fluid line 16 is connected to a lower end of the vessel 15. As shown in FIGS. 2 and 3, the upper end 21 of the tubing is preferably connected through the center of the lower end of the bottle 15 by means of a connector 22, most preferably a ⅜ inch nylon bulkhead.

Continuing with FIGS. 1 through 3, fluid flows by gravity from the vessel 15 through the tubing 16 to the condensate pan 11. The rate of flow is controllable by means of the flow control device 18 on the tubing. The flow control device 18 preferably surrounds and compresses the tubing at some point along its length (preferably above/before the in-line drip chamber). A user can tighten the flow control device 18 to restrict the amount of flow through the line, or release the flow control device to allow fluid to drip from the line into the condensate pan at a greater drip rate, as appropriate for controlling bacterial and mold growth in the condensate pan. Too high a drip rate is not required to control microbial growth, wastes fluid, and increases the amount of combined effluent draining from the condensate pan.

Figure 4:
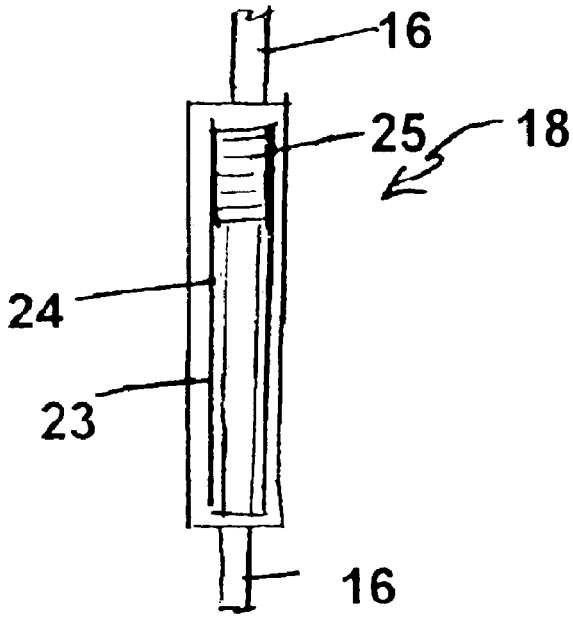
FIG. 4 is an elevational view of a wheeled flow control device according to FIG. 3.
Figure 5:
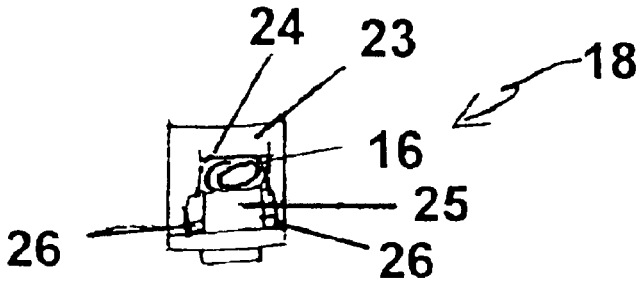
FIG. 5 is a top plan view of a wheeled flow control device according to FIG. 4.

Any suitable means of controlling flow rate may be used, including a simple clamp. Suitable flow control devices include a wheeled flow control device 18, as shown in FIGS. 1 through 3. As shown in FIGS. 3, 4 and 5, the wheeled flow control device 18 comprises an open ended plastic-type sleeve 23. The front of the sleeve comprises a longitudinal channel 24. A portion of the tubing 16 passes along the channel (i.e., through the sleeve) at about a 20 degree angle with respect to the longitudinal axis of the channel. A knurled, rotatable wheel 25 is movably mounted in the channel 24 within the sleeve. The wheel 25 comprises matching posts 26 extending from (or a single post passing through) the center of the wheel. Each post extends laterally from an opposite side of the wheel 25. The wheel posts 26 extend into grooves 27 along the inside of the sleeve, so that the wheel is rotatable and movable along the channel 24. A user can rotate the wheel 25 with his or her thumb, and at the same time move the wheel up and down an upper portion of the channel 24. Moving the wheel 25 down pinches the tubing 16 closed, which impedes fluid flow in the tubing, slowing the drip rate. Moving the wheel 25 up opens the tubing channel 24, allowing the fluid in the tubing 16 to flow freely, which increases the drip rate from the end of the tubing.

Figure 6:
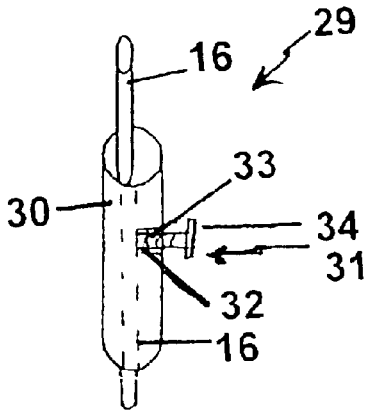
FIG. 6 is a perspective view of a thumb screw flow control device according to the present invention.

Alternative flow control devices for use herein include a thumb-screw-type flow control device 29 shown in FIG. 6. The thumb screw-type flow control device 29 comprises a cylindrical barrel 30 surrounding a section of the tubing 16, with a thumb-type screw 31 inserted through an opening 32 in the side of the cylindrical barrel. As shown in FIG. 6, the diameter of the cylindrical barrel 30 is slightly greater than the outside diameter of the tubing 16, and the tubing 16 passes easily through the open upper and lower ends of the barrel. The end 33 of the screw 31 impinges on the section of tubing 16. At the opposite end of the screw, the screw head 34 is rotatable for tightening or loosening the screw. When the thumb screw 31 is tightened, its end 33 presses the section of tubing against the rigid back wall of the cylindrical barrel 30, restricting fluid flow through the tubing. The cylindrical barrel is preferably made of a strong, transparent, plastic-type material. When the thumb screw 31 is loosened by rotating the head, pressure in the tubing 16 is decreased, and the fluid rate is increased.

The fluid used in the device to kill existing microorganisms and prohibit their regrowth is preferably a bleach solution (less than about 5% bleach) or an enzyme-containing solution, although any effective, safe antibacterial fluid may be used. Decontaminating fluids, or a powder, such as a powdered detergent, and a fluid, such as water, may be mixed in the receptacle by simply adding the components at the top opening and shaking the receptacle. The decontaminant fluid controls microbial growth in the drip pan as well as in the vessel and fluid line. A slow drip is preferred, most preferably three to five minutes per drip. Depending on the size of the vessel, and the rate of flow, the user should periodically replenish the fluid in the vessel. For most HVAC systems, for example, a one gallon vessel will last several months and will require a refill two to four times per year. A fluid-filled two gallon jug will last approximately 20 to 24 weeks.

With continued attention to FIG. 3, the first section **16*a* of fluid line 16*a* leads from the flow control device to the drip chamber 17. The drip chamber 17 includes a hollow, generally pear-shaped chamber 35. An end of the first section 16*a* of fluid line opens to an upper end of the drip chamber, and a port in a lower end of the drip chamber opens to an upper end of a second section 16*b*** of fluid line.

As shown in FIG. 3, the generally vertical second tubing section **16*b* makes an approximately 90 degree angle at 36, so the longitudinal axis of the lower end portion 37 of the second tubing section lies in a generally horizontal position, as does the longitudinal axis of the drain pan. The lower end portion 37 of the second tubing section is inserted through a cylindrical drain pan sleeve 38 into the drain pan 14. The drain pan sleeve 38 is attached to a side of the drain pan 14 at the bottom of the air conditioning unit 13. The end tubing portion 37 lies in the drain pan 14, as shown in FIG. 3**, so that the decontaminating fluid drips into the drain pan.

In the alternate embodiment of the decontaminant device shown in FIG. 2, the generally vertically oriented second tubing section **16*b* is angled by means of a connector 39, most preferably a ¾ inch polyvinylchloride connector, so that the end tubing portion 37 is forced into a generally horizontal position for fitting into the drain pan. The fluid drips from the end of the end tubing portion 37** into the drain pan.

In the alternate embodiment shown in FIG. 1, the generally vertically oriented second tubing section 16*b* is angled by means of a connector 39, so that the end tubing portion 37 is forced into a generally horizontal position for fitting into the drain pan. A first end of the connector 39 is connectable to one end of the drain pan sleeve 38, as indicated by the arrow in FIG. 1. An opposite, second end of the connector 39 is attachable to a first end 42 of an elbow joint 40. An opposite, second end 43 of the elbow joint is attachable to a first end 44 of a drain line 41, as indicated by the arrow in FIG. 1. An opposite, second end 45 of the drain line 41 empties into an appropriate drain (not shown), as desired by the user.

Figure 7:
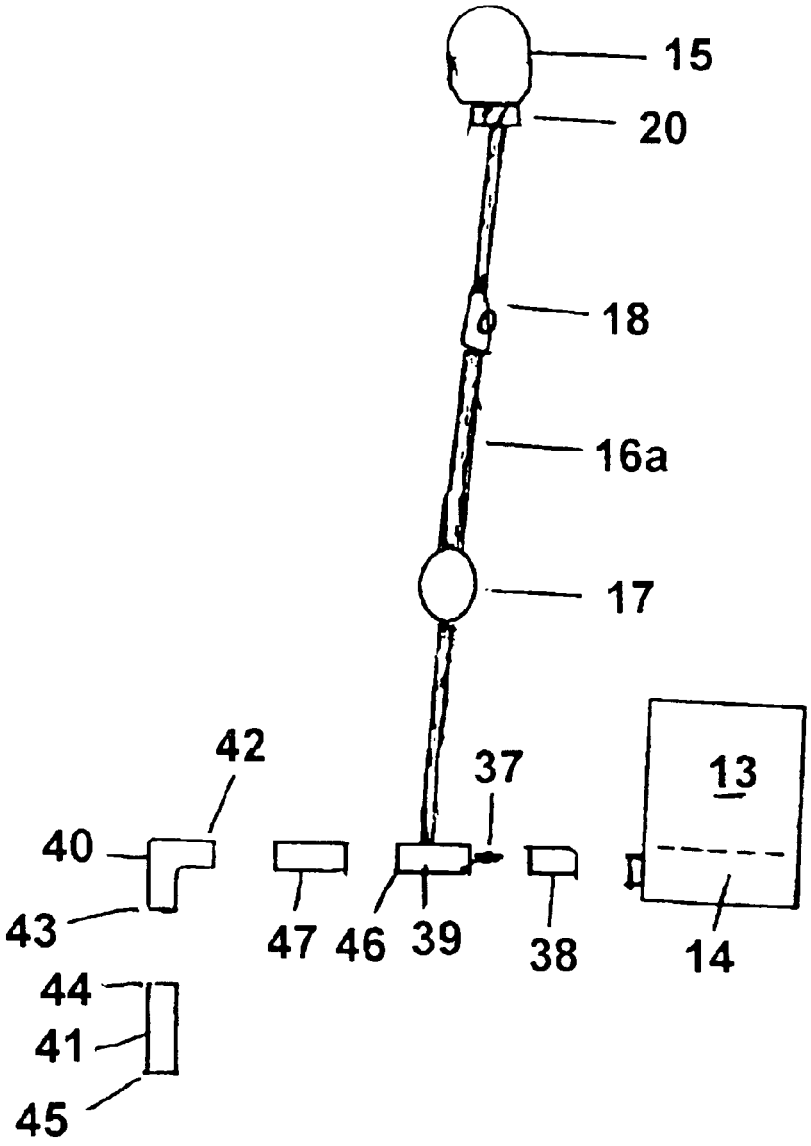
FIG. 7 is a schematic view of a decontaminant device according to the present invention, showing exploded views of parts of the device.

Turning now to FIG. 7, an alternate embodiment of the device includes a jug vessel 15 (most preferably a one or two gallon jug), with a screw-off cap 20 on the lower end of the jug. An upper end of a first section 16*a* of fluid line is connected through the cap 20 on the lower end of the jug. To refill the jug 15, the user removes the jug from its attachment, detaches the jug from the line, inverts the jug, fills it, replaces the cap on the jug, reattaches the line, inverts the jug and rehangs it. The fluid line passes through a flow connector device 18 and into a tubular-shaped drip chamber 17. An upper end of a second section 16*b* of fluid line is attached to the lower end of the drip chamber 17. As shown in FIG. 7, a lower portion 37 of fluid line extends through a connector 39 and a drain pan sleeve 38 into a drain pan 14 of an air conditioner unit 13. An opposite end 46 of the connector 39 is connectable to a first end of a section of pipe 47, most preferably a three inch section of ¾ inch polyvinyl chloride pipe. An opposite, second end of the pipe 47 is connectable to a first end 42 of an elbow joint 40. An opposite, second end 43 of the elbow joint is attachable to a first end 44 of a drain line 41. An opposite, second end 45 of the drain line 41 empties into an appropriate drain (not shown), as desired by the user.

Figure 8:
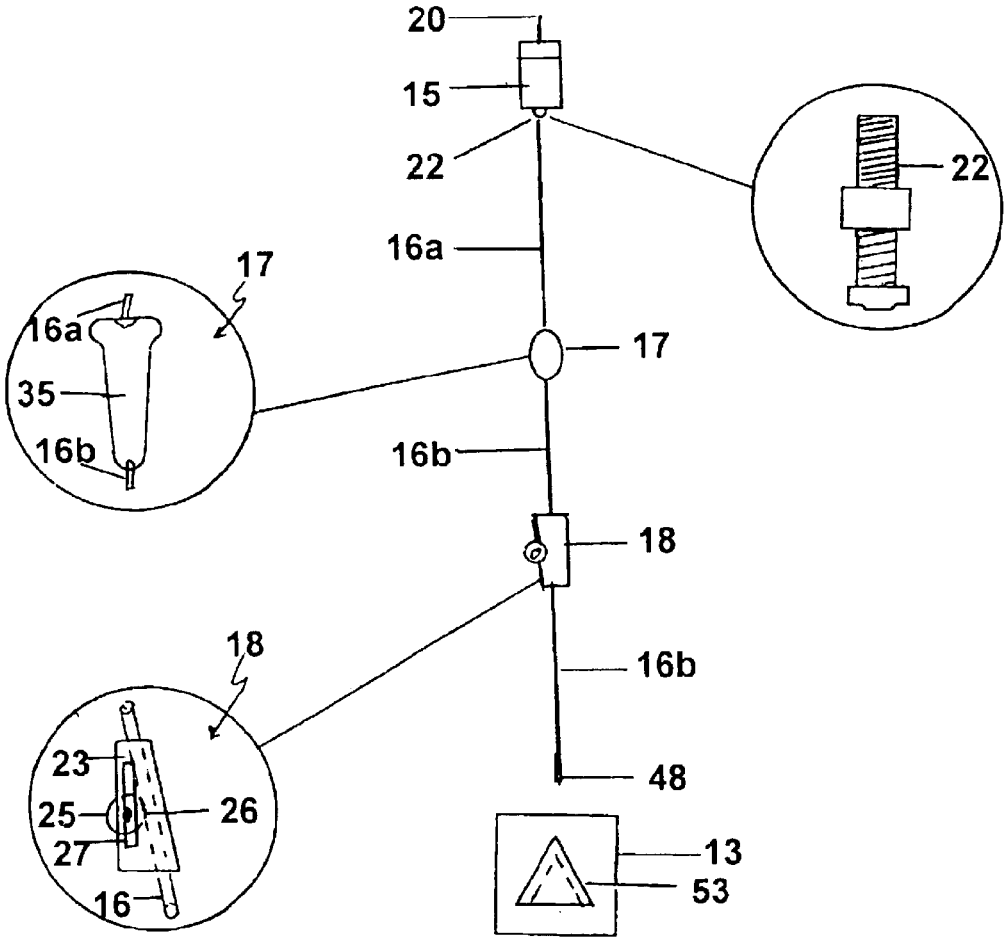
FIG. 8 is a schematic view of a decontaminant device according to the present invention, showing exploded views of parts of the device.

Turning now to FIG. 8, an alternate embodiment of the device of the present invention includes a vessel 15 with a screw-off cap 20 at its upper end. A first end of a first section 16*a* of fluid line, preferably medical tubing, is connected to the bottom of the vessel 15 in fluid communication with the vessel. An opposite, second end of the first tubing section 16*a* is connected to a drip chamber 17. A first end of a second section 16*b* of tubing is connected to the lower end of the drip chamber 17 and extends downward in a generally vertical direction through a flow control device 18 as described above. The opposite, lower end of the second tubing section 16*b* can be clamped or otherwise removably affixed to a drain pan.

Figure 9:
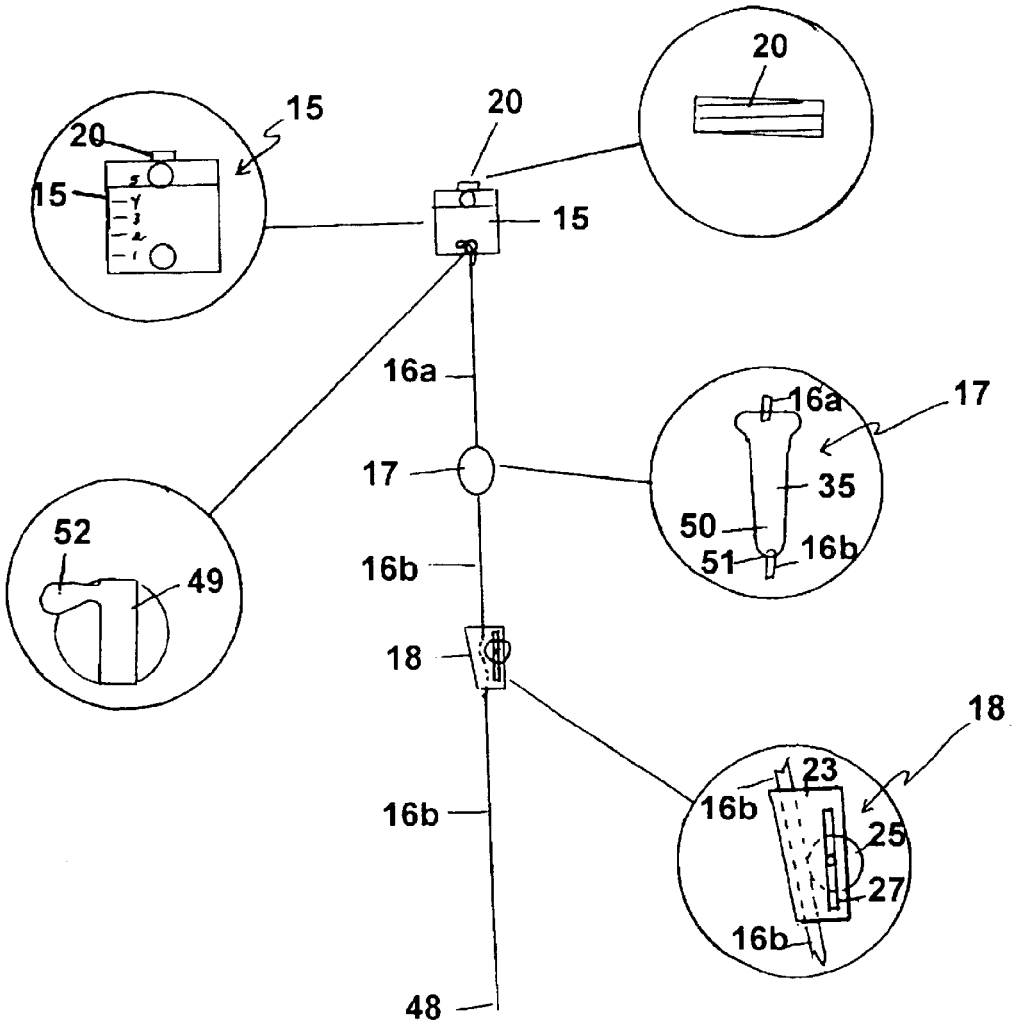
FIG. 9 is a schematic view of a decontaminant device according to the present invention, showing exploded views of parts of the device.

Referring to FIG. 9, an alternate embodiment of the device of the present invention includes a vessel 15, which is a five gallon jug with a molded drain. The jug has a screw-off plastic cap 20 at its upper end. As shown in FIG. 9, the jug 15, which is made of a translucent material, includes increments for measuring the amount of fluid remaining inside the jug. A first end of a first section 16*a* of fluid line, preferably flexible tubing, is connected to a spigot 49 at the base of the vessel 15. The tubing 16 is in fluid communication with the vessel 15. An opposite, second end of the first tubing section 16*a* is connected to a drip chamber 17. A first end of a second section 16*b* of tubing is connected to the lower end of the drip chamber 17 and extends downward in a generally vertical direction through a flow control device 18 as described above. The opposite, lower end of the second tubing section 16*b* can be clamped or otherwise removably affixed to a drain pan.

Alternatively, the device shown in FIG. 8 may be suspended above the air conditioner unit 13, with the lower end 48 of the tubing 16*b* positioned directly over the condensation coils 53 of the air conditioner. In this embodiment, the fluid is a suitable type of fragrance, such as a potpourri oil. The fluid dripping onto the coils 53 mixes with the condensate on the coils. The air drawn through the coils by the air conditioner fan blows across the coils carrying the fragrance. The resulting pleasant odor is distributed through the supply vents into the house, clinic, or other building.

As shown in FIG. 9, the drip chamber 17 includes a hollow, generally pear-shaped chamber 35. The chamber includes a flexible flap 50 extending in a generally horizontal direction from an inside wall of the chamber 35 over a port 51 in a lower end of the drip chamber opens to an upper end of a second section 16*b* of fluid line. The drips passing from the port at the upper end of the chamber pass over the flexible flap 50. The flap thus acts as a further means of slowing the drip rate. The drip rate can also be slowed by turning the spigot handle 52 toward the closed position, or increased by turning the spigot handle toward the open position.

From the foregoing it can be realized that the described device of the present invention may be easily and conveniently utilized as a for holding and dispensing a fluid for decontaminating a condensate drip pan over time. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 device
11 condensate drip pan
12 eaves
13 air conditioner unit
14 condensate drain pan
15 vessel
16 fluid line
17 drip chamber
18 flow control device
20 screw-off plastic cap
21 upper end of fluid line
22 bulkhead connector
23 sleeve
24 channel
25 wheel
26 wheel posts
27 sleeve grooves
29 thumb screw flow control device
30 cylindrical barrel

31 thumb screw
32 barrel opening
33 end of screw
34 screw head
35 chamber
36 tubing angle
37 end tubing portion
38 drain pan sleeve
39 connector
40 elbow joint
41 drain line
42 first end of elbow joint
43 second end of elbow joint
44 first end of drain line
45 second end of drain line
46 end of connector
47 section of pipe
48 end of second tubing section
49 spigot
50 flexible flap
51 lower chamber port
52 spigot handle
53 condensation coils

What is claimed is:

1. A device for holding and dispensing an antimicrobial fluid for decontaminating a condensate drip or drain pan, the device comprising:

(a) a vessel at one end of the device for holding the fluid;

(b) at least one fluid line having a first end inserted in a lower end of the vessel, and an opposite, lower, second end inserted in the condensate drip or drain pan;

(c) a flow control device on the fluid line for controlling a rate of fluid drip from the fluid line into the condensate drip or drain pan; and (d) a drip chamber in the fluid line;

wherein the fluid line is comprised of two sections of flexible, medical tubing, and a lower end portion of a second one of the tubing sections extends through a cylindrical drain pan sleeve into the condensate drip or drain pan, the drain pan sleeve being attached to a side of the condensate drip or drain pan.

2. The device according to claim 1, further comprising an elbow a lower section of the fluid line for directing the lower end of the fluid line into the condensate drip or drain pan.

3. The device according to claim 1, wherein the drip chamber is a hollow chamber, with a third end of the fluid line opening to an upper end of the drip chamber, and a port in a lower end of the drip chamber opening to a fourth end of the fluid line.

4. The device according to claim 1, wherein the first end of the fluid line is attached to the vessel by a bulkhead connector.

5. The device according to claim 1, further comprising a connector between the generally vertically oriented second tubing section and the end tubing portion, a first end of the connector being connectable to an end of the drain pan sleeve.

6. The device according to claim 5, wherein an opposite, second end of the connector is attachable to a first end of an elbow joint, an opposite, second end of the elbow joint being attachable to a first end of a drain line.

7. The device according to claim 1, wherein the generally vertically oriented second tubing section is angled by means of an elbow joint, so that the end tubing portion is in a generally horizontal position.

8. The device according to claim 3, wherein the drip chamber further comprises a flexible flap extending from an inside wall of the chamber into the chamber.

9. The device according to claim 1, wherein the fluid further comprises a fragrance.

* * * * *